US005267836A

United States Patent [19]

Culp

[11] Patent Number: 5,267,836

[45] Date of Patent: Dec. 7, 1993

[54] MADREPORITIC RESONANT PUMP

[75] Inventor: Gordon W. Culp, Van Nuys, Calif.

[73] Assignee: Rockwell International Corporation, Seal Beach, Calif.

[21] Appl. No.: 951,981

[22] Filed: Sep. 28, 1992

[51] Int. Cl.[5] ..... F04B 19/24

[52] U.S. Cl. ..... 417/52; 417/207

[58] Field of Search ..... 417/52, 53, 20, 207

[56] References Cited

U.S. PATENT DOCUMENTS

| | | | |
|---|---|---|---|
| 3,397,648 | 8/1968 | Henderson | 417/207 |
| 3,586,461 | 6/1971 | Erlandson | 417/53 |
| 3,743,446 | 7/1973 | Mandroian | 417/322 |
| 4,640,667 | 2/1987 | Trepp | 417/52 |
| 5,020,977 | 6/1991 | Lucas | 417/557 |
| 5,051,066 | 9/1991 | Lucas | 417/207 |

*Primary Examiner*—Richard A. Bertsch
*Assistant Examiner*—Roland G. McAndrews, Jr.
*Attorney, Agent, or Firm*—H. Fredrick Hamann; Harry B. Field; Steven E. Kahm

[57] ABSTRACT

A multiplicity of heaters 50 on the surface 10 of a hollow torus chamber 4 are employed to exobarically stimulate the fluid contained in the chamber to make a resonant traveling wave 20 which has its high pressure peaks 22 adjacent outlet ports 16 and its negative pressure peaks 26 adjacent inlet ports 12, thus pumping the fluid. The traveling wave can be composed of two waves having a phase difference. A controller 62 directs the heaters to exobarically stimulate the fluid so as to create the traveling wave in the fluid. Heaters 50 can act as anemometers to detect the position of the waves in the chamber so that the controller may determine when to add pulses to the wave. By having a traveling wave which always has a high pressure peaks 22 adjacent to outlet ports 16 and its negative pressure peaks 26 adjacent inlet ports 16, no valves are required to make the pump function, thus eliminating any moving parts in the pump. Further, the pump can be made with materials which operate at high temperatures with dependence on curie temperatures, such as pumps having permanent magnets, magnetically permeable cores, piezoelectric materials and ferroelectric substances would encounter.

14 Claims, 2 Drawing Sheets

MADREPORITIC RESONANT PUMP

BACKGROUND OF THE INVENTION

1. Field of the Invention

The present invention relates to an electrically activated fluid pump having a valveless non-working chamber resonantly responsive to sequenced exobaric pulsation.

2. Description of the Related Art

Industrial and aerospace fluid pumps are subjects of continuous development to increase operating temperature range, achieve longer life through greater reliability, and to reduce manufacturing cost by simplifying design to in part offset the use of costlier materials.

In reference U.S. Pat. No. 3,743,446 issued Jul. 3, 1973, Mandroian describes his resonant pump consisting of a non-working chamber (in the sense that there is no gross movement of a chamber wall portion such as a piston) having a flexible diaphragm chamber wall portion that is oscillated by an electrical transducer, and fluid inlet and outlet ports. The diaphragm oscillation stimulates a standing wave having pressure nodes and velocity nodes (pressure antinodes). The fluid inlets and fluid outlets of the chamber are arranged proximate the respective nodes. Mandroian is correct that at instants of positive pressure a pressure node near an outlet forces fluid thereout. Mandroian is also correct that at instants of negative pressure at a pressure antinode near an inlet induces fluid therein. Mandroian concludes that fluid exiting the outlets and fluid entering the inlets constitute a pumping action, which is indeed correct. However, Mandroian overlooked the fact that the pressure at a pressure node passes through alternating positive and negative maxima, that the pressure node is stationary in a standing wave, and therefore, at a half period of time later than the time fragment illustrated by Mandroian's FIG. 2, the conditions will be reversed, namely, flow direction arrows will be reversed from those shown. Therefore, fluid portions proximate inlets and outlets simply oscillate instead of being pumped. Mandroian overlooked the fact that, in a standing wave, the time averages of fluid particle pressure, velocity, and fluid particle displacement, are all essentially zero. Therefore the pump would not work unless it had valves at the inlet and output ports, which it did not have.

A disadvantage of Mandroian's pump, and pumps in general, is reliance on mechanical transducing means. In Mandroian the two mechanical transducing means described for stimulating resonance in the fluid of the pumping cavity are a core with a current coil interacting with a magnetic slug, and a piezoelectric crystal. Both magnetic and electrostrictive transducers have an operating temperature range bounded by Curie temperature(s) outside of which satisfactory operation, and possibly even survivability, is not possible. Another disadvantage of Mandroian's pump, had it worked as described, is the range of frequencies over which operation is possible. His apparatus is described as an electromechanical oscillator in which chamber length, fluid state, elastic nature of the diaphragm, and the electrical elasticity of the driving electrical circuit all contribute to initiating and sustaining chamber resonance. The diaphragm is described as being designed to vibrate at a predetermined frequency, implying at most a relatively limited range of operating frequencies.

Applicant's copending patent applications Ser. No. 07/870,885 filed Apr. 20, 1992 and Ser. No. 07/807,667 filed Dec. 16, 1991 a continuation-in-part of Ser. No. 07/697,368 filed May 9, 1991 are hereby made a part hereof and incorporated herein by reference. The applications describe methods and apparatus using a multiplicity of small and highly responsive electric resistance heaters. A current pulse exobarically stimulates proximate fluid which in turn produces useful mechanical work. Each heater, and alternatively, each heater group, is independently electrically activated to create predetermined spatial and temporal distributions of fluid dynamic force. The heaters do not rely on Curie temperatures for proper operation and survivability, and therefore operate in a range of temperatures significantly wider than that of all (excluding capacitors) other known electrical components. Methods are described in which a fluid body adjunct to the multiplicity of heaters is perturbed, such perturbations clearly including the stimulation of acoustic waves.

SUMMARY OF THE INVENTION

The madreporitic resonant pump consists of a fluidly resonant chamber having an internal madreporitic surface, a surface that contains a multiplicity of pores, each pore housing at least one electrical resistance heater that fluidly and thermally communicates with the chamber. Heaters are electrically connected and activated, individually, or in sets, in a prescribed sequence. Through the wall of the chamber is at least one inlet port located a predetermined distance from at least one outlet port. In a chamber filled with fluid a heater activation sequence initiates and sustains a resonant longitudinal traveling wave. The wave group speed, the wave pressure oscillation timing, and the port spacing are coordinatedly designed so that a wave portion attains maximum positive pressure only while passing the vicinity of an outlet port, and attains maximum negative pressure only while passing the vicinity of an inlet port, thereby constituting a pump in which the only moving component is the traveling wave itself. The traveling wave provides the action of valves. The heaters are resistant to high temperatures, intense magnetic fields, and ionizing radiation. Madreporitic pumps made of materials that do not depend on a Curie temperature operate in the near zero to 2000 Kelvins range. Resonance enhances pumping efficiency. Selected heaters can be used as pump fluid state sensors that facilitate electrical control.

OBJECTS OF THE INVENTION

The object of the invention is to pump a fluid by heat pulses, which create traveling waves having maximum positive pressure at outlet ports and maximum negative pressure at inlet ports.

Another object of the present invention is to pump fluid with low initial cost, in a very wide temperature range, and with few identifiable effects that shorten life, such as parts that move, flex, weld or rub.

Other objects are the achievement of the pumping of fluids by: using transducers without Curie temperatures; using acoustical resonance to enhance pumping efficiency; using traveling waves in place of mechanical or fluidic valves; enhancing electrical reliability through massive redundancy; enhancing fluid reliability by use of multiple inlet and outlet ports; and, simplifying construction through surface material transfer manufacturing methods.

Another object is more accurate control of a pump by using an element of the wave excitation means as a sensor.

DETAILED DESCRIPTION OF THE INVENTION

Figure 1:
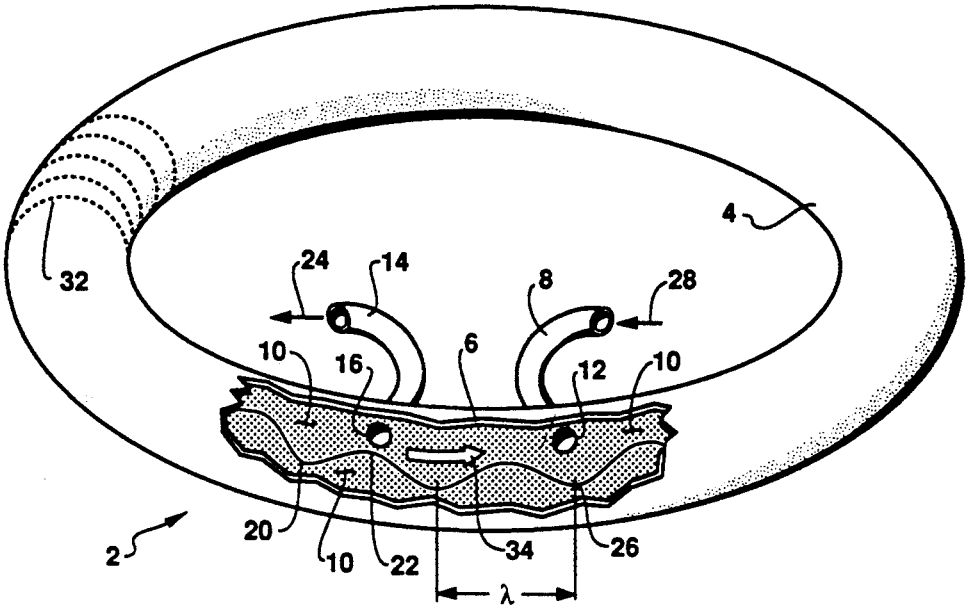
FIG. 1 is a cut away perspective view of a toroidal embodiment of the madreporitic resonant pump (omitting electrical connections for clarity).

FIG. 1 is a cut away perspective view of a toroidal embodiment of the madreporitic resonant pump. The pump 2 consists of a hollow toroidal body 4 having wall 6 lined with madreporitic (heated pores) surface 10 and filled with a fluid. Pump 2 is connected to a fluid supply by fluid inlet conduit 8, and to a fluid receiver by fluid outlet conduit 14. Conduits 8 and 14 open to the torus interior by inlet port 12 and outlet port 16 respectively. Electrical connections (omitted for clarity) are made to groups of heater pores of madreporitic surface 10, group boundaries indicated by dashed lines 32. Each heater group is independently electrically activated by a control means.

Figure 2:
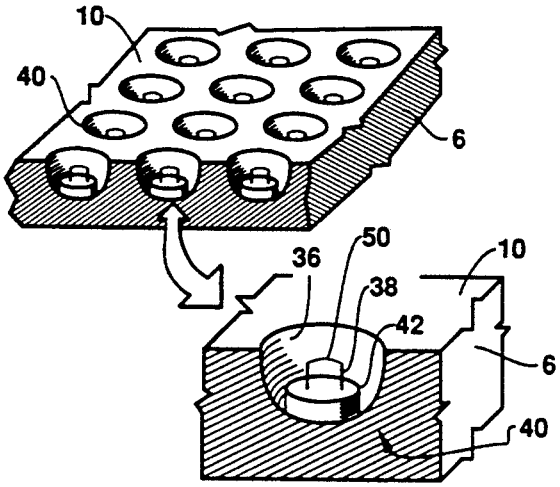
FIG. 2 is a perspective portion view of the madreporitic surface of the pump of FIG. 1, and a magnified view of a heated cavity of the madreporitic surface.

FIG. 2 is an enlarged perspective portion view of the madreporitic surface 10 of FIG. 1, and includes a magnified view of one cavity. Madreporitic surface 10 is the interior surface of toroidal body wall 6 and consists of myriad cavities 40. Each cavity has an electrically insulating heater support 42, heater electrical connections 38, and resistance heater element 50.

Figure 3:
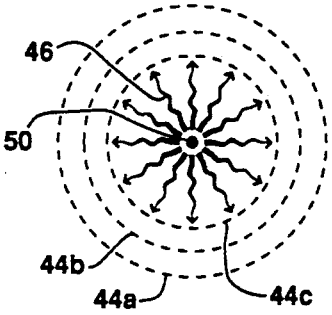
FIG. 3 is a cross section view illustrating heater action.

FIG. 3 is a cross section view illustrating heater action. In the figure, heater element 50 has completed a current pulse. The current pulse adds heat 46 to fluid proximate heater 50. The fluid exobarically pulses the fluid (schematically represented by broken line circle 44*c*). Previous exobaric pulses are shown as 44*b* and 44*a*, having moved further away from heater 50. Heaters may be operated as exobaric stimulators, and alternatively, by measuring the resistance in a heater element, provides a measure of the fluid state interior to pump body 4.

During operation, fluid in pump body 4 is stimulated by periodic activation of heater groups 32 to resonate as a traveling wave 20 (FIG. 1). At the instant illustrated, the traveling wave consists of a prescribed number of positive pressure antinodes, typically 22, and a like number of negative pressure antinodes, one of which is shown as 26, the whole wave train circulating pump body 4 in direction 34. At this instant, the positive pressure 22 proximate outlet port 16 allows fluid to exit pump body 4, while negative pressure at 26 proximate inlet port 12 allows fluid to enter. The length $\lambda$ of wave 20, the distance between ports 12, 16, and the speed of travel in direction 34 are predetermined to produce pumping action.

A fluid wave passing through a tube may be represented by a single wave equation. Alternatively, a wave may be represented by the sum of two waves of the same frequency. The two waves may differ in phase. When the phase difference is zero, the two waves constructively interfere and may be represented by a single wave of larger amplitude. When the phase difference is a half period, as occurs for example in a resonantly excited closed tube having a length that is an integer number of wavelengths, the sum wave appears to be stationary, each pressure antinode of which alternately passes through maximum positive pressure and through maximum negative pressure. When the phase difference meets none of the foregoing conditions, the pressure antinodes of the sum wave appear, and may be described as traveling along the tube with a speed that may differ from the fundamental speed of sound in the fluid. Adjustment of the phase of one of the waves adjusts the speed of the sum wave, also called the group speed.

Figure 5:
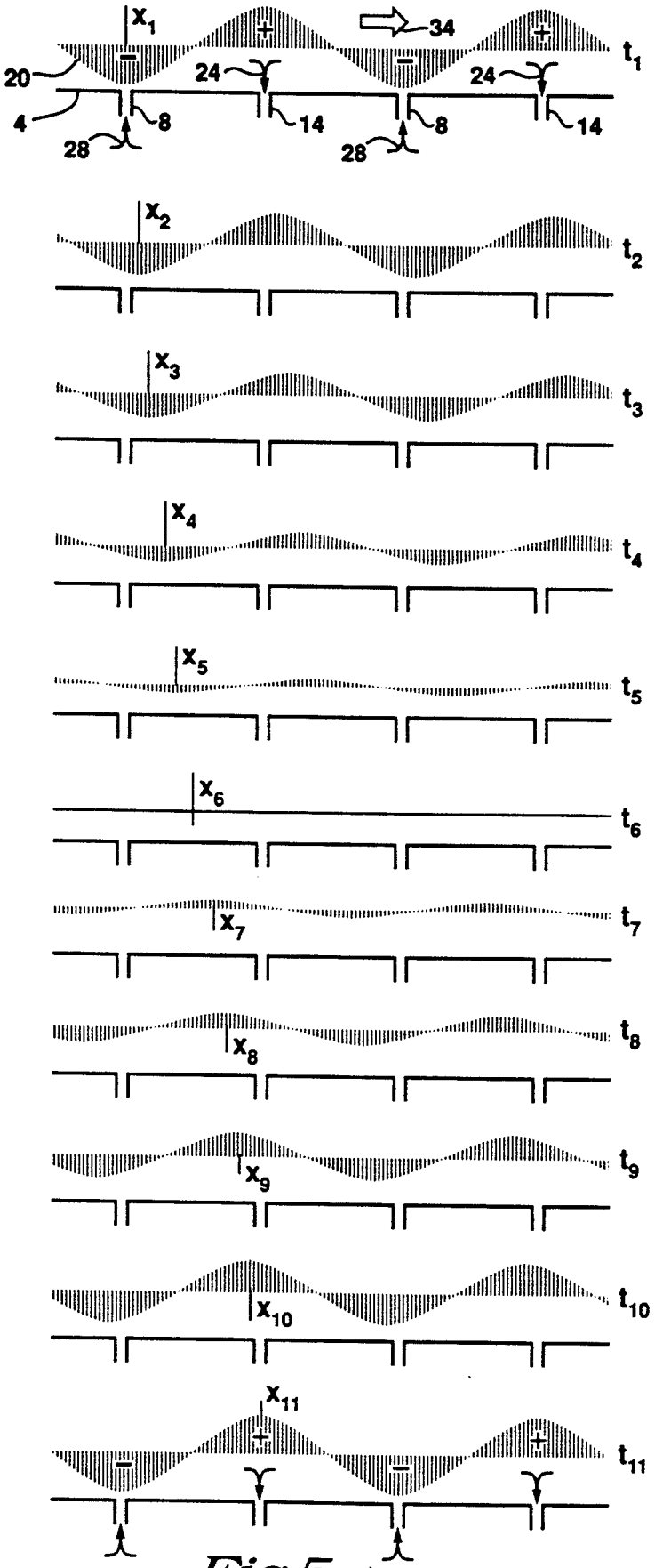
FIG. 5 is a schematic animated sequence of madreporitic pumping action by traveling waves passing pump ports.

The operation of the pump is better understood with reference to FIG. 5, an animated time and location sequence of a single pump cycle (relative to a fluid port). Schematically, pump body 4 fixed relative to the figure, shown straight for clarity, has two or more inlets 8 and two or more outlets 14 fixed thereto. Traveling wave 20 circulates at constant predetermined speed around pump body 4 in direction 34. In wave 20, positive pressure is indicated + and negative pressure by a −. In the figure time increases vertically downward by tenth cycle increments shown as time intervals $t_1$ . . . $t_{11}$. Arbitrarily, the pump cycle begins at time $t_1$, as negative pressure antinode-located at $x_1$ lies over and admits fluid 28 from inlet port 8, while positive pressure antinode + (located a half wave length from $x_1$) lies over and forces fluid 24 out of port 14. By time $t_2$ the traveling wave has moved a distance $x_2 - x_1$, while the magnitudes of antinode pressures have decreased. Antinode pressure magnitudes continue to decrease until $t_6$, at which time they are essentially zero, and antinode locations x have moved to positions midway between the ports. Time $t_6$ is also the instant at which each pressure antinode changes polarity from positive to negative, and the converse. From times $t_6$ to $t_{11}$ antinodes increase in pressure magnitude. The negative antinode previously located at $x_1$ at $t_1$ has reached maximum positive pressure at location $x_{11}$ by time $t_{11}$. Since the now positive antinode is located over the next (outlet) port, additional fluid 24 is exhausted from ports 14 and induced 28 by way of ports 8. The pumping cycle repeats from time $t_{11}$ to time $t_1$ in time, but not necessarily in space. In the figure the pumping cycle repeats temporally in times $t_1$ . . . $t_{11}$, while spatially each antinode reaches maximum pressure magnitude at a new and opposite pressure polarity as it arrives at the next port along pump body 4.

Figure 4:
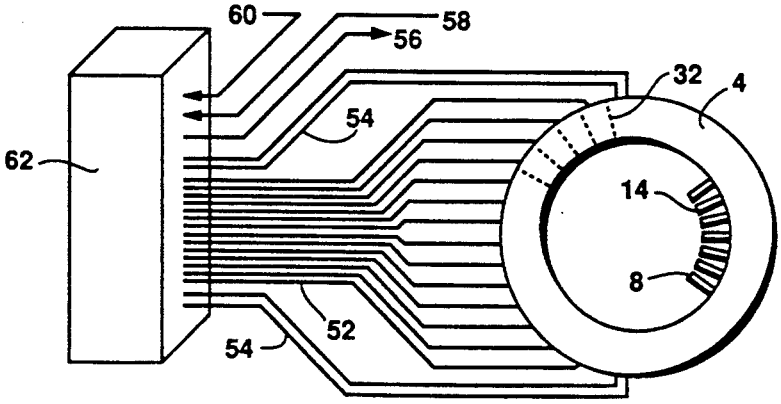
FIG. 4 is a schematic control system diagram showing fluid and electrical connections.

FIG. 4 is a schematic control system diagram showing fluid inlet and outlet conduits 8, 14, and electrical connections 52, 54 between controller 62 and pump body 4. The controller is supplied with input electrical power 60. The controller may optionally issue status data 56 to ancillary apparatus. The controller can receive pump operating instruction signals from an external exigency by one or more lines 58.

Heaters 50 of madreporitic pump surface 10 are connected in groups indicated by dashed lines 32. Each group of heaters is activated at a predetermined time responsive to one of the signals 52. Heater groups may be allocated to one of two waves, for example, a first wave circulating in direction 34 (FIG. 1), and a second wave circulating oppositely. Controller 62 times the exobaric pulsations so that the fluid develops two or more waves having a phase difference necessary to produce the prescribed wave speed. A wave is stimulated when a heater produces a positive pressure pulse at the instant when the positive pressure portion of a wave passes by. The controller 62 stimulates heater groups in succession around the pump body, thereby advantageously adding a portion of the pressure pulse of one heater group to the pressure of the next heater group in the direction of wave travel. Heaters are not efficient generators of negative pressure pulses. In addition, heaters are rectifying transducers, in that a heater produces a positive pressure pulse regardless of the polarity of the electrical pulse applied thereto.

As previously described, any heater or group of heaters may be used as sensors, commonly called hot wire anemometers. Selected heaters of FIG. 4 are used as anemometers and provide controller 62 with electrical signals by way of connections 54. Controller 62 extracts from signals 54 information corresponding to the state of the fluid in the pump body, such as pressure, temperature, and speed. This information is used by the controller to determine if the fluid state has changed from predetermined values, and if so, corrections are made to signals 52.

Epitaxial methods of making madreporitic surfaces are disclosed in the patents which were incorporated herein by reference above. When it is easier to deposit madreporitic surfaces on a planar substrate, the pump body, consisting of a collection of conterminous polygons, can be assembled as a mosaic of heater group "tiles". The preferred embodiment of each tile of the mosaic provides deposited electrical interconnections, and terminals for connection to a controller, thereby greatly easing the making of such pumps. Enough tiles are used to provide a semblance of a pump body appropriate to the passage of traveling waves.

In another embodiment of the invention the cavities 40 may have a chemical augmenter of exobaricity such as a catalyst which is chemoexobarically responsive to the fluid, thus the heaters' effectiveness will be increased.

Although the present invention has been described with respect to specific embodiments thereof, various changes and modifications may be suggested to one skilled in the art. Therefore, it is intended that the present invention encompass such changes and modifications as fall within the scope of the appended claims.

What is claimed is:

1. A pump comprising, a chamber filled with a fluid, the chamber having a fluid inlet, a fluid outlet spaced from said inlet, and a means of producing waves in the fluid, wherein said means of producing waves makes a traveling wave which reaches peak positive pressure at instants of passing the fluid outlet and that reaches peak negative pressure at instants of passing the fluid inlet, wherein said fluid outlet is spaced an integral number of half wavelengths from said fluid inlet and the means of producing waves includes a multiplicity of electrical resistance heater elements on the surface of the chamber which selectively exobarically pulse the fluid.

2. A pump as in claim 1, wherein a controller sends currents to the heaters to produce the waves.

3. A pump as in claim 2, wherein the controller receives signals from the heaters to detect the waves.

4. A pump as in claim 3, wherein the chamber is a hollow torus.

5. A pump as in claim 4, wherein the traveling wave is a composite of two waves having a phase difference.

6. A pump as in claim 5, wherein the traveling wave resonates in said chamber.

7. A pump as in claim 1, wherein the traveling wave is a composite of two waves having a phase difference.

8. A pump as in claim 7, wherein the traveling wave resonates in said chamber.

9. A pump as in claim 1, wherein the chamber is a hollow torus.

10. A pump as in claim 9, wherein the traveling wave is a composite of two waves having a phase difference.

11. A pump as in claim 10, wherein the traveling wave resonates in said chamber.

12. A pump as in claim 1, wherein the means of producing waves includes a heater face portion that is a chemical augmenter of exobaricity.

13. A pump as in claim 12, wherein the augmenter is a catalyst.

14. A pump as in claim 13, wherein the fluid is chemoexobarically responsive to said augmenter.

* * * * *